US007987688B2

(12) United States Patent
Thizon et al.

(10) Patent No.: US 7,987,688 B2
(45) Date of Patent: Aug. 2, 2011

(54) TURNING KNOB WITH LOCK

(75) Inventors: Patrice Thizon, Ruelle-sur-Touvre (FR); Bernard Desaphie, Saint Yrieix (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 294 days.

(21) Appl. No.: 11/815,774

(22) PCT Filed: Feb. 9, 2006

(86) PCT No.: PCT/EP2006/050793

§ 371 (c)(1),
(2), (4) Date: Aug. 8, 2007

(87) PCT Pub. No.: WO2006/089844

PCT Pub. Date: Aug. 31, 2006

(65) Prior Publication Data

US 2008/0141744 A1 Jun. 19, 2008

(30) Foreign Application Priority Data

Feb. 24, 2005 (FR) ..... 05 50508

(51) Int. Cl.
*E05B 9/04* (2006.01)

(52) U.S. Cl. ..... 70/370; 70/373; 70/379 R; 70/451; 70/461; 70/492; 70/DIG. 30; 70/DIG. 39; 200/43.08; 200/43.11

(58) Field of Classification Search ..... 70/361, 70/461, DIG. 36, DIG. 39, 495, 372–374, 70/492, DIG. 30, 379 R, 379 A, 380, 370, 70/451; 200/43.08, 336, 43.11, 11 R, 11 A, 200/11 D, 11 E, 11 G, 11 H, 11 J, 11 K, 43.04, 200/43.09, 564, 568, 570, 571, 11 DA
See application file for complete search history.

(56) References Cited

U.S. PATENT DOCUMENTS

| | | | | | |
|---|---|---|---|---|---|
| 2,060,951 | A | * | 11/1936 | Rae et al. | 200/43.11 |
| 2,748,210 | A | * | 5/1956 | Frank | 200/43.13 |
| 2,778,891 | A | * | 1/1957 | Jacobi | 200/11 C |
| 2,803,716 | A | * | 8/1957 | Nolden et al. | 200/43.08 |
| 3,212,307 | A | * | 10/1965 | Hallgren | 70/492 |
| 3,988,911 | A | * | 11/1976 | Lipschutz | 70/490 |
| 4,009,357 | A | * | 2/1977 | Naylor | 200/43.08 |
| 4,227,056 | A | * | 10/1980 | Johnston et al. | 200/43.11 |
| 4,689,456 | A | * | 8/1987 | Martin | 200/43.08 |
| 4,728,756 | A | * | 3/1988 | Martin | 200/43.08 |
| 4,980,524 | A | * | 12/1990 | Braun | 200/43.08 |
| 5,055,643 | A | * | 10/1991 | Pardini et al. | 200/318.2 |
| 5,732,580 | A | | 3/1998 | Garnault et al. | |

(Continued)

FOREIGN PATENT DOCUMENTS

EP 0 012 075 6/1980

(Continued)

*Primary Examiner* — Lloyd A Gall
(74) *Attorney, Agent, or Firm* — Oblon, Spivak, McClelland, Maier & Neustadt, L.L.P.

(57) ABSTRACT

A turning knob with a lock for an electric circuit indicating a body for receiving a barrel rotating relative to a stator. The barrel includes springs receiving a key configured while rotating to take up at least two functional retained or released positions and having at one of its ends a shank configured to be actuated by rotating the key. The body has an inner cylindrical sleeve whereon the stator is urged to be positioned, the inner sleeve having a number of identical members for positioning the stator, each positioning member of the inner sleeve matching a corresponding positioning member of the stator, so as to select the position of the stator relative to the body.

15 Claims, 7 Drawing Sheets

U.S. PATENT DOCUMENTS

| | | | | |
|---|---|---|---|---|
| 5,775,147 | A * | 7/1998 | Wittwer | 70/379 R |
| 5,799,520 | A * | 9/1998 | Laabs et al. | 70/360 |
| 6,041,631 | A * | 3/2000 | Vonlanthen | 70/492 |
| 6,446,475 | B1 * | 9/2002 | Agnatovech et al. | 70/379 R |
| 6,782,725 | B2 * | 8/2004 | Linares | 70/360 |
| 2002/0026817 | A1 * | 3/2002 | Greer | 70/370 |
| 2003/0150701 | A1 * | 8/2003 | Kuepper et al. | 200/43.08 |
| 2005/0223764 | A1 * | 10/2005 | Pierson et al. | 70/370 |
| 2007/0199806 | A1 | 8/2007 | DaDalt et al. | |

FOREIGN PATENT DOCUMENTS

| | | |
|---|---|---|
| EP | 0 769 597 | 4/1997 |
| EP | 0 874 114 | 10/1998 |

* cited by examiner

Section A-A

Section B-B

Section C-C

TURNING KNOB WITH LOCK

BACKGROUND OF THE INVENTION

1. Field of the Invention

The present invention pertains to a turning knob with lock comprising a body in which are housed a stator, a barrel or rotor controlled by a key and a control component able to switch contacts of an electrical block.

2. Discussion of the Background

A turning knob with lock is used to establish prolonged or fleeting electrical contact in order to activate a process. In the case where electrical contact is prolonged, the turning knob comprises several positions and will be able to permit one or more key withdrawals. On the other hand in the case where electrical contact is fleeting, the turning knob generally permits only a single key withdrawal.

When the turning knob with lock is of the positions type and if it permits several key withdrawals, it may be necessary to be able to offer the client identical knobs in which key withdrawals do not all occur in the same position. In order to decrease manufacturing costs and to limit difficulties during assembly, it may turn out to be beneficial to use one and the same stator to obtain various combinations of key withdrawals.

SUMMARY OF THE INVENTION

The aim of the invention is therefore to offer a turning knob with lock in which it is possible to obtain, on the basis of one and the same stator, various combinations of key withdrawals.

This aim is achieved by a turning knob with lock for electrical circuit comprising a body able to house a barrel turning with respect to a stator, said barrel comprising tabs, receiving a key that can take by rotation at least two functional positions, held or fleeting, and exhibiting at one of its ends a shank actuatable by rotation of said key. Said knob is characterized in that,

- the body exhibits an internal cylindrical sleeve on which the stator positions itself,
- the internal sleeve exhibits a plurality of identical positioning members for the stator, each positioning member of the internal sleeve being complementary to a corresponding positioning member of the stator, so as to be able to choose the position of the stator with respect to the body.

According to the invention, it is therefore possible to choose the position of the stator in the body, therefore the position of the lateral opening of the stator with respect to the body and the one in which the key may be withdrawn. The members for positioning the sleeve and stator are complementary and comprise for example identical notches formed on a flange of one of the ends of the internal sleeve and a crown of complementary flutes formed at an end of the stator. The notches at the end of the sleeve therefore slot into the corresponding flutes of the stator.

According to a first embodiment, the stator exhibits two diametrically opposite lateral openings.

According to a second embodiment, the stator exhibits six diametrically opposite lateral openings.

In a knob turning by a quarter turn, it is therefore possible to obtain on the basis of these two stator embodiments, one, two or three key withdrawals at various positions and to offer all the combinations of key withdrawals.

According to a feature, the body of the knob exhibits a flared part furnished with an external collar, a cup defined between said collar and the internal sleeve being able to receive a helical spring loading a sensitivity ring that can move in translation.

According to another feature, the knob also comprises a lock-cover housed in the body and secured to the barrel, said lock-cover exhibiting teeth able to cooperate with cam shapes formed on the sensitivity ring.

According to another feature, the sensitivity ring is able to be temporarily linked to the stator by way of intermeshing means. Such a characteristic makes it possible to facilitate assembly of the knob in particular when the latter is achieved in an automatic manner with the aid of machines.

According to another feature, the intermeshing means comprise at least two studs formed on the lateral wall of the stator and the ring is held bearing against a shoulder formed on the stator by way of the studs bearing on a collar formed on the ring. During assembly of the knob, the ring is stripped of the stator by exerting a pressure on the latter. The intermeshing means are therefore used temporarily and should not hinder the normal operation of the turning knob. Other means for fastening the sensitivity ring to the stator may be envisaged.

According to a variant embodiment of the knob, the cup defined above is able to receive a torsion spring loading the barrel during its rotation. In this case one is dealing with a so-called restoring turning knob that can take two positions one of which is fleeting. Such a knob does not comprise any sensitivity ring and uses a stator exhibiting two diametrically opposite lateral openings so as to permit only a single key withdrawal.

BRIEF DESCRIPTION OF THE DRAWINGS

Other characteristics and advantages will appear in the detailed description which follows while referring to an embodiment given by way of example and represented by the appended drawings in which.

DETAILED DESCRIPTION OF THE PREFERRED EMBODIMENTS

Figure 1:
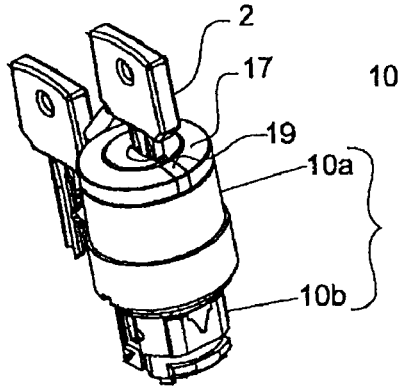
FIG. 1 represents a turning knob with lock according to the invention.
Figure 2:
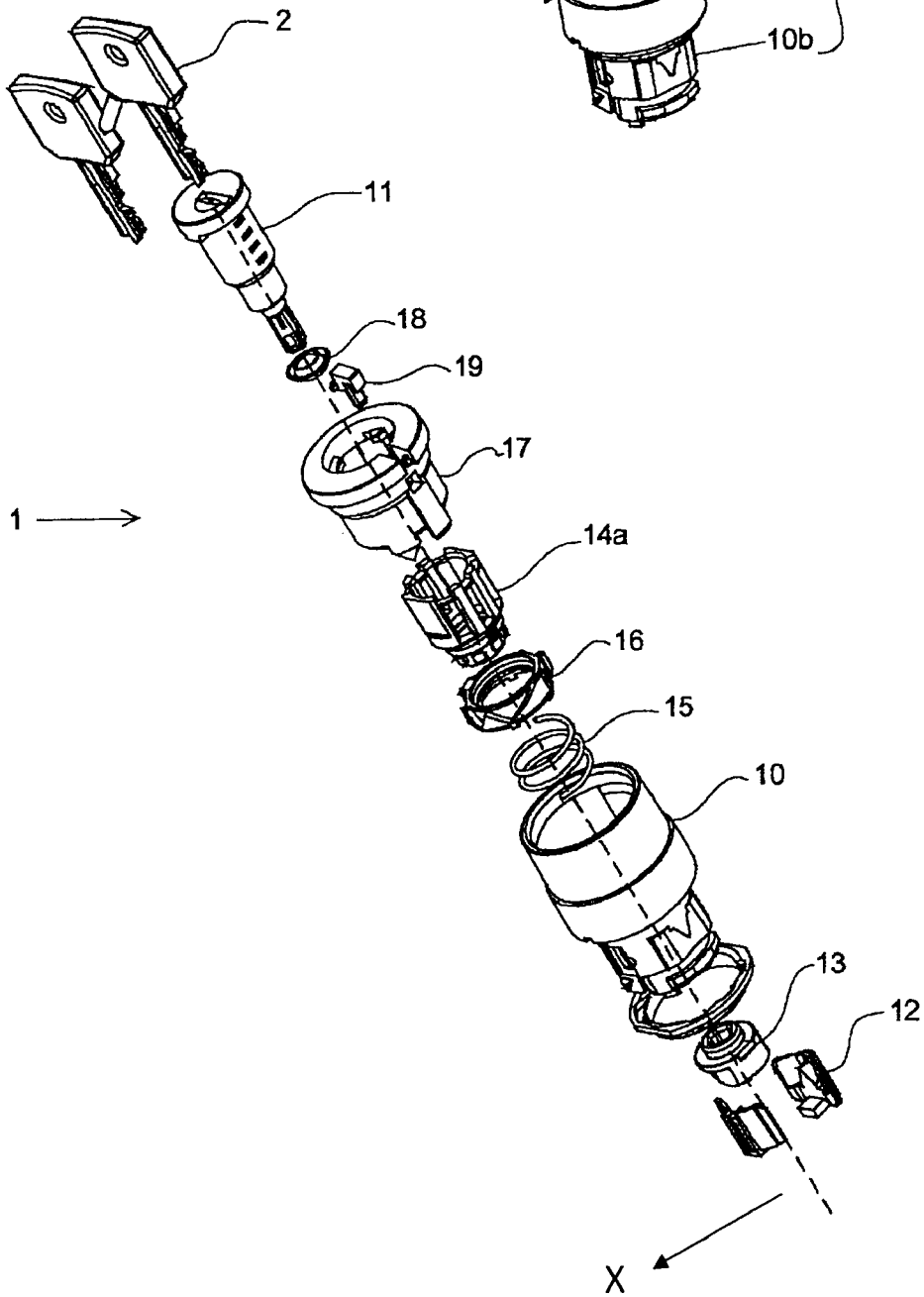
FIG. 2 represents, in perspective and exploded, the turning knob with lock according to the invention.
Figure 3:
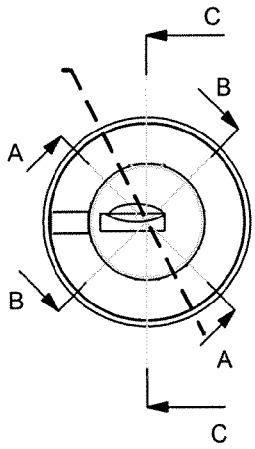
FIG. 3 represents, seen from above, the turning knob with lock according to the invention.

The turning knob with lock illustrated in the figures is a knob 1, 1 operated with the aid of a key 2 turning in a barrel 11. This knob 1, 1' comprises a body 10 having the form of a tubular component axisymmetric about an X axis. It is intended to be fixed in an opening made in a panel or a wall for example by means of a customary fixing base (see patent application EP 889 564). Below the base is mounted at least one breaker electrical block, the assembling of each electrical block to the base being performed by attachment means such as those described in patent WO 97/28552. The barrel 11 is mounted rotatably with respect to the body 10 and can take at least two functional positions, held or fleeting.

Subsequently in the description, the use of the terms "axial", "axially", "coaxial" or "transverse" are defined with respect to the aforesaid X axis.

Likewise the terms "top", "bottom", "upper", "lower", "above", "below" or terms with equivalent senses should be understood with respect to the aforesaid X axis when the latter is vertical.

FIGS. 1 to 9F represent a turning knob 1 with lock that can take at least two held positions.

The body 10 of this knob 1 exhibits a wide top part 10*a* and a narrower bottom control part 10*b*.

The bottom part 10*b* of the body 10 comprises runner shapes 100 (FIG. 7A) for guiding sliders 12 which, during the rotation of the key 2 and therefore of the barrel 11, move in translation along the X axis under the action of a control component 13.

Figure 9A:
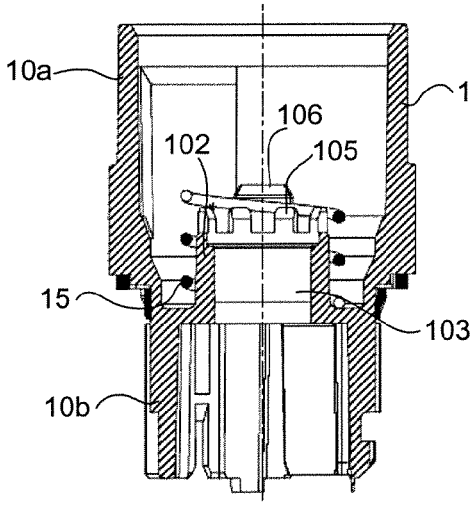
FIGS. 9A to 9F represent various steps for assembling the turning knob with lock according to the invention.

The wide top part 10*a* is furnished with a cylindrical external top collar 101, and with an internal collar concentric with the external collar, having the shape of a sleeve 102 defining an axial central opening 103 (FIG. 9A). The external collar 101 and the sleeve 102 define between them a cup 104. The upper flange of the internal sleeve 102 exhibits a plurality of identical notches 105 (FIG. 7A) standing parallel to the X axis. These notches 105 are intended to position a stator 14*a*, 14*b* furnished with complementary identical flutes 140. The notches 105 are received into the corresponding structure of the stator formed between the flutes 140 of the stator.

Figure 5A:
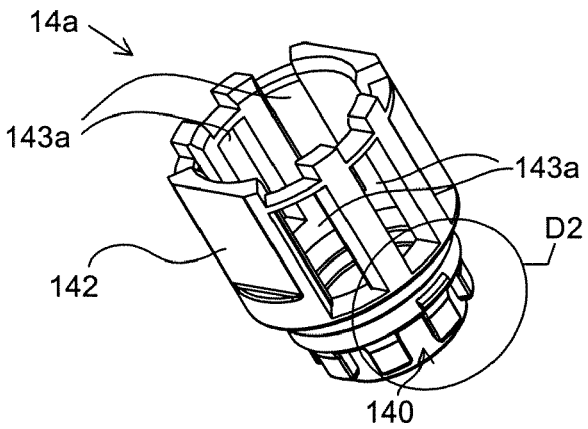
FIGS. 5A and 5B represent, in perspective, two variant embodiments of a stator used in the knob with lock according to the invention.
Figure 9B:
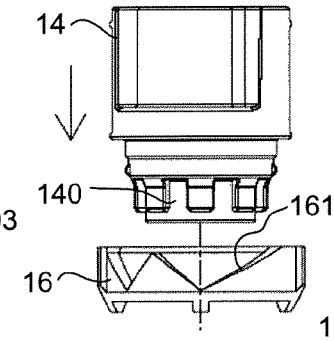
Figure 9C:
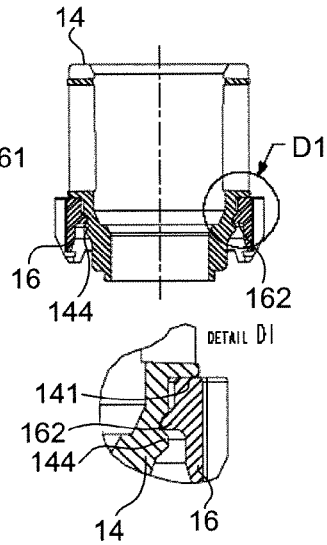

According to a first variant embodiment represented in FIG. 5A, the stator 14*a* has the shape of an axisymmetric component mounted in a coaxial manner in the knob 1. The stator 14*a* comprises a substantially cylindrical top part and a likewise cylindrical bottom part but of smaller diameter, defining between them a transverse annular shoulder 141 (FIG. 9C). Two diametrically opposite flats 142 are formed on the external surface of the top part of the stator 14*a*. Between these two flats 142, the lateral surface of the top part of the stator 14*a* comprises six identical diametrically opposite openings 143*a*. At its bottom part, the stator 14*a* exhibits a fluted crown, whose flutes 140 are oriented longitudinally along the X axis. These flutes 140 are complementary to the notches 105 formed on the upper flange of the internal sleeve 102 of the body 10 and are intended to cooperate with them. The notches 105 and the corresponding flutes 140 form members for positioning the stator 14*a* on the body 10.

Figure 5B:
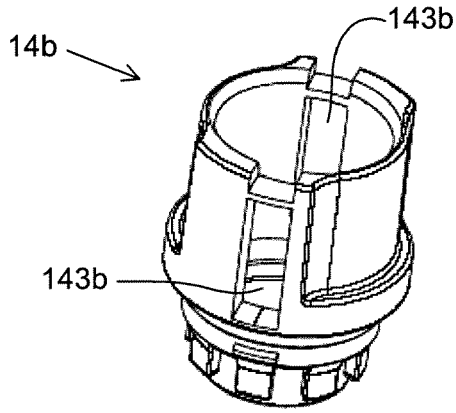

The stator 14*b* according to the second variant embodiment and represented in FIG. 5B, differs from that described above by the fact that:

It simply comprises two diametrically opposite lateral openings 143*b*.

It does not comprise any flats on the lateral surface of its top part.

Subsequently in the description, we will use the reference "14" to refer to the two stator variants. It will be necessary to understand this description as well as corresponding FIGS. 1 to 9F as being applicable to both variant embodiments of the stator.

Figure 7A:
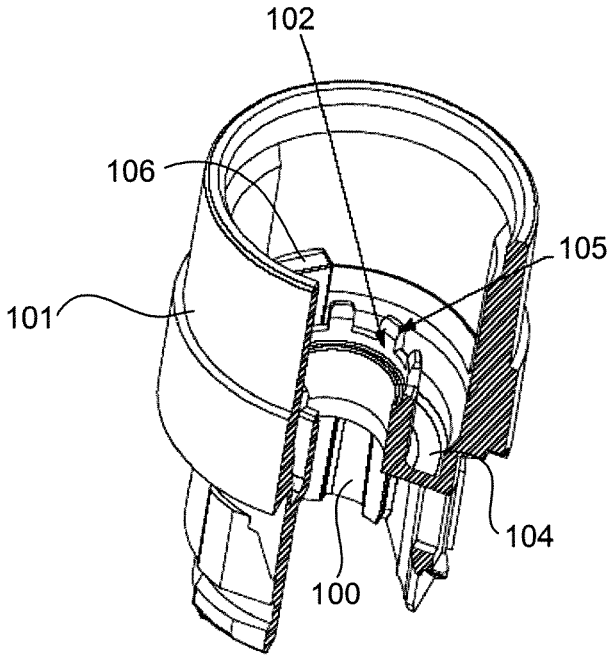
FIG. 7A represents, in perspective, the body of the turning knob with lock according to the invention.
Figure 7B:
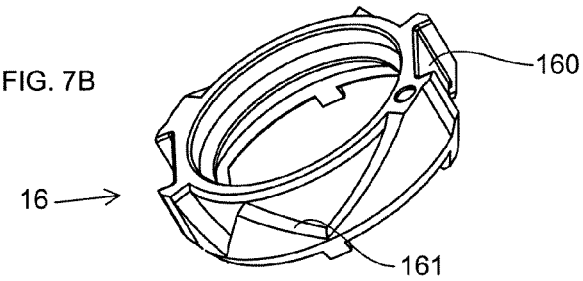
FIG. 7B represents, in perspective, the sensitivity ring.
Figure 7C:
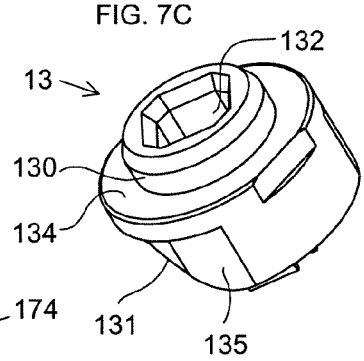
FIG. 7C represents, in perspective, the control component.

The cup 104 defined between the collar 101 and the internal sleeve 102 of the body 10 houses a helical compression spring 15 applied on the one hand to the bottom of the cup 104 and on the other hand against a sensitivity ring 16 (FIGS. 2 and 7B) so as to load the latter along the X axis. The body 10 exhibits on the internal surface of its top part 10*a* two diametrically opposite runners 106 (FIGS. 4B and 7A) in which the sensitivity ring 16 is able to slide along the X axis when it is loaded. To slide axially against the runners of the body, the sensitivity ring 16 comprises nooks 160 or other analogous trough-like or relief-like shapes (FIG. 7B). The sensitivity ring 16 also comprises actuation cam shapes 161 corresponding to the desired functional positions of the knob 1.

Figure 4A:
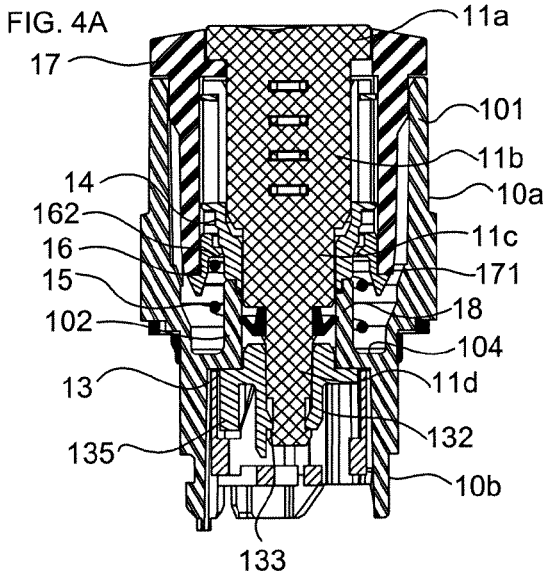
FIGS. 4A to 4C represent, viewed on the longitudinal sections A-A, B-B and C-C defined in FIG. 3, the turning knob with lock according to the invention.
Figure 4B:
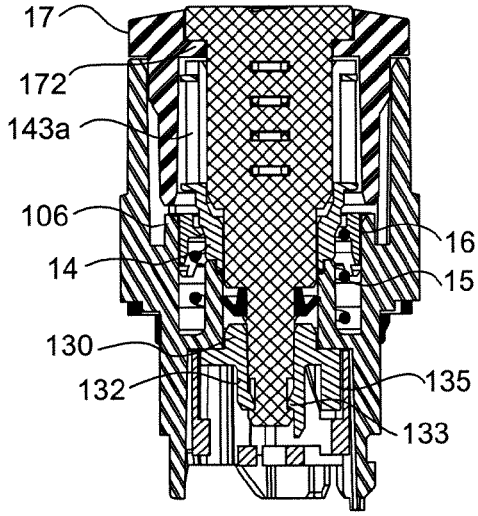
Figure 4C:
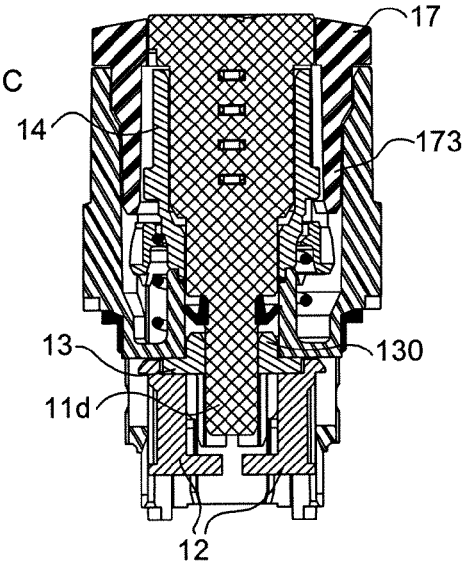
Figure 7D:
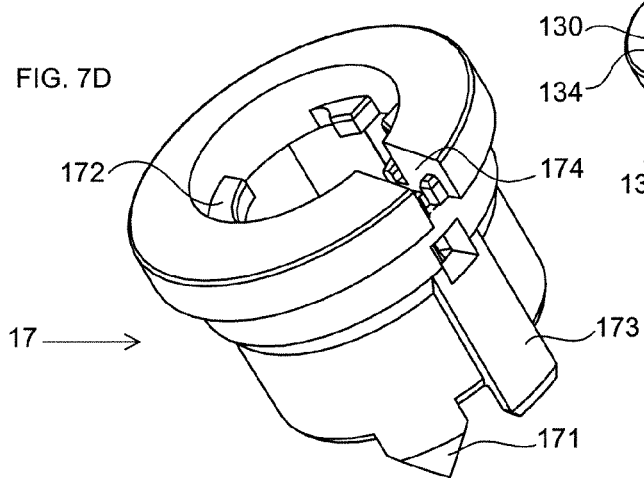
FIG. 7D represents, in perspective, the lock-cover.

The sensitivity ring 16 is loaded in translation by a lock-cover 17 (FIG. 7D) having the form of an axisymmetric component inserted axially between the stator 14 and the top part 10*a* of the body 10. The lock-cover 17 exhibits an upper collar defining a transverse annular shoulder 172 by which it rests on the upper flange of the body 10 of the knob 1 (FIGS. 4A to 4C). This lock-cover 17 follows the cam shapes 161 provided on the sensitivity ring 16 with the aid of two diametrically opposite teeth 171 with beveled end, extending downwards, along the X axis (FIGS. 4A and 7D). In proximity to its upper end, on its internal surface the lock-cover 17 exhibits projections 172 forming transverse surfaces intended to constitute bearings for a head 11*a* of the barrel 11. The two flats 142 made on the exterior surface of the stator 14 make it possible to prevent the burr of the join plane that arises from the manufacture of the stator from hindering the rotation of the lock-cover 17 in the body 10 of the knob.

Figure 6:
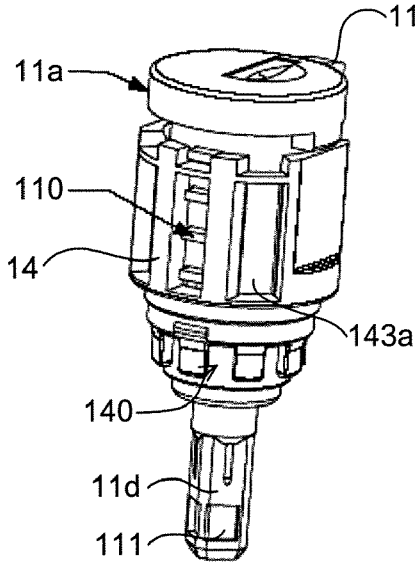
FIG. 6 represents, in perspective, a stator of FIG. 5A in which a key-type barrel is inserted.

The head 11*a* of the barrel 11 bears against the projections 172 of the lock-cover 17 such that the barrel 11 and the lock-cover 17 are rotationally fastened. The head 11*a* of the barrel is lengthened along the X axis by an intermediate part 11*b* comprising tabs 110 (FIG. 6) forming the lock mechanism. When these tabs 110 are situated opposite a lateral opening 143*a*, 143*b* of the stator 14, withdrawal of the key 2 from the barrel 11 is possible. During this key withdrawal 2, the tabs 110 exit the barrel and project into the opening of the stator 14 facing them. The barrel 11 can therefore no longer rotate in the stator 14. The tabs 110 are each associated with a spring (not represented) which, during the withdrawal of the key 2, brings them back outwards. During the insertion of the key 2, the notches present on the key pull the tabs 110 inwards into the stator 14. Once the key 2 has been pushed fully into the barrel 11, the tabs 110 no longer project through the opening of the stator, thus permitting the barrel 11 to rotate in the stator 14. The lock-cover 17 comprises a cleft 174 intended to receive an index 19 (FIG. 2) allowing a user to tag the position of the knob 1. The tabs 110 project from the barrel 11 for example away from this index 19 (FIG. 6).

The intermediate part lib of the barrel 11 is lengthened by a span 11*c* for centering in the central opening 103 formed by the sleeve 102, which is applied against the internal face of the sleeve 102 of the body 10 and which offers an annular shoulder or a furrow for receiving a lip seal 18 ensuring good leaktightness with the internal face of the sleeve 102. The barrel 11 terminates with a shank lid intended to intermesh with the control component 13 with the aid of intermeshing shapes 111 (FIG. 6) interlocking with respective shapes of the control component 13 (FIGS. 4A and 4B). The shank lid of the barrel also exhibits indexation shapes, for example squares, for rotationally engaging the control component 13.

To limit the rotation of the barrel 11, the lock-cover 17 secured to the barrel 11 comprises two axial and diametrically opposite lateral lugs 173 (FIGS. 4C and 7D), in relief on its external surface, turning in relation to the internal surface of the collar 101 of the body 10, between two abutments formed on this internal surface. The rotational sweep of the barrel 11 is for example a quarter turn. The barrel 11 is engaged in the lock-cover 17 so that the tabs 110 of the barrel are opposite one of the lateral lugs 173 of the lock-cover 17.

The control component 13 (FIG. 7C) has the form of a tubular component exhibiting, at its top part, a span for centering 130 in the opening 103 defined by the internal sleeve 102 of the body 10 and, at its bottom part, cam shapes 131 for actuating the sliders 12. It also exhibits an internal sleeve 132 of square and constant transverse section into which is inserted the shank 11*d* of the barrel 11 (FIGS. 4A to 4C). Intermeshing shapes 133 are provided on the internal surface of this sleeve for cooperating with the corresponding intermeshing shapes 111 of the shank 11*d* of the barrel 11. The control component 13 furthermore comprises a coaxial external cylindrical portion 135 with a lower edge whose contour defines the cam shapes 131. The skirt 135 forms with the centering span 130 an annular shoulder 134 defining a transverse surface opposite the lower flange of the internal sleeve 102 of the body 10.

Figure 5C:
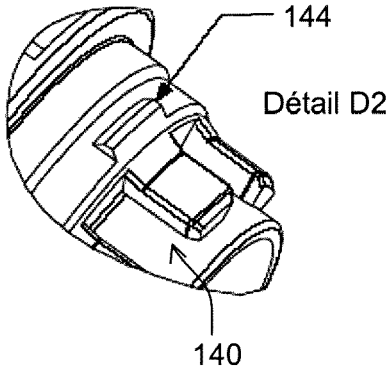
FIG. 5C represents a detail D2 of the stator illustrated in FIG. 5A.

According to the invention, between its top part and its bottom part the stator 14 also exhibits means for intermeshing the sensitivity ring 16 (FIGS. 5A to 5C). During assembly of the knob 1, the sensitivity ring 16 is axially intermeshed with the stator 14. These intermeshing means comprise at least two diametrically opposite studs 144 (FIG. 5C) formed on the lateral wall of the stator 14, above the flutes 140. The sensitivity ring 16 comprises an internal collar 162 defining a lower transverse annular surface against which the studs 144 bear and is gripped between said studs 144 and the annular shoulder 141 defined between the top part and the bottom part of the stator 14.

Figure 9D:
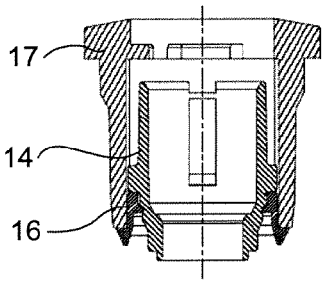
Figure 9E:
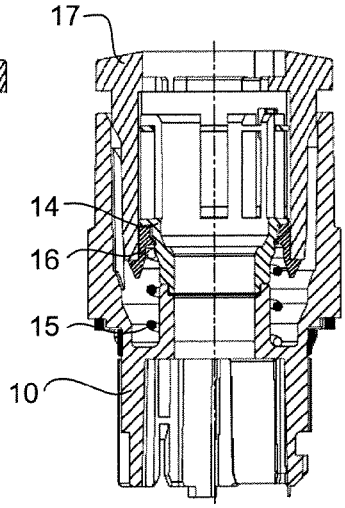
Figure 9F:
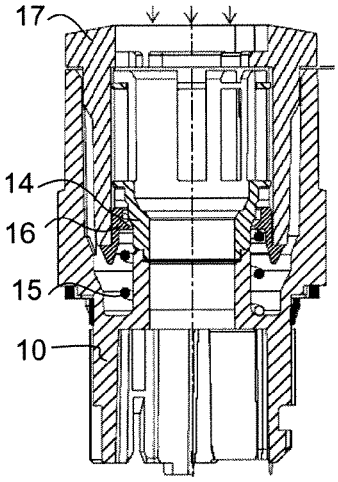
Figure 10:
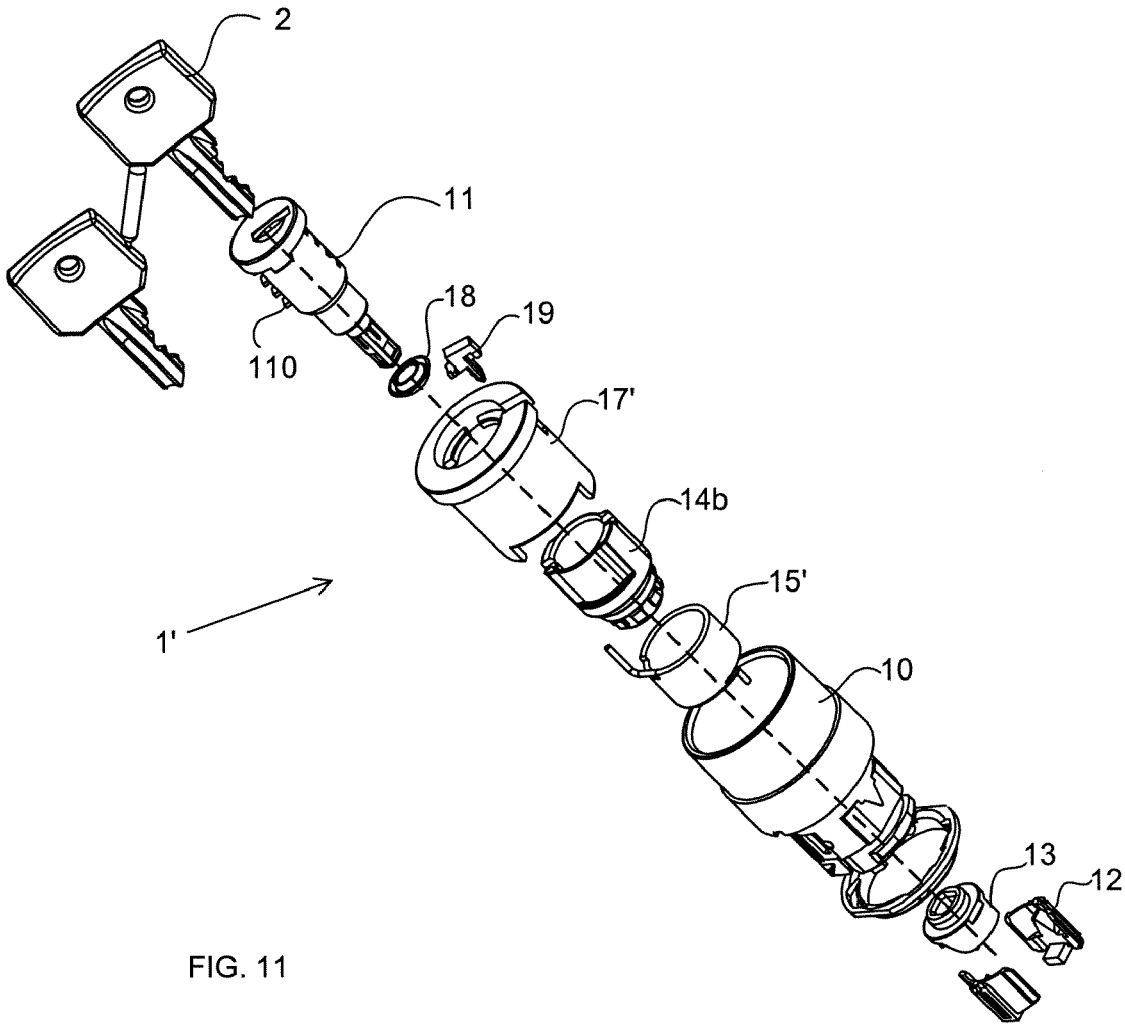
FIG. 10 represents, in perspective and exploded, a variant embodiment of the knob with lock according to the invention.
Figure 11:
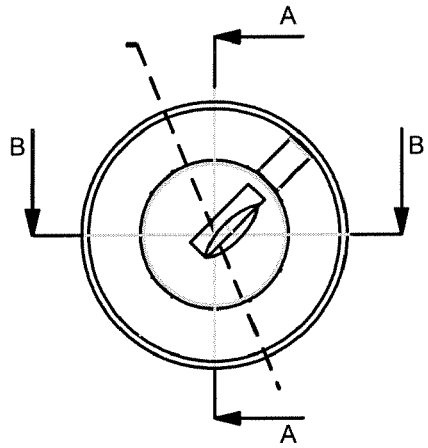
FIG. 11 represents, seen from above, the turning knob with lock according to the variant embodiment of FIG. 10.

With reference to FIGS. 9A to 9F, assembly of the knob 1 occurs in the following manner:

In the body of the knob 1 is placed firstly the helical spring 15 in the cup 104 defined between the internal sleeve 102 and the external collar 101 (FIG. 9A). Thereafter, as explained above, the sensitivity ring 16 is temporarily intermeshed with the stator 14 (FIGS. 9B and 9C). The lock-cover 17 is thereafter placed around the stator 14 so that its teeth 171 cooperate with the cam shapes 161 provided on the sensitivity ring 16 (FIG. 9D). The lock-cover/stator/sensitivity ring subassembly is thereafter inserted along the X axis into the body 10 of the knob 1 so that the flutes 140 of the stator 14 cooperate with the corresponding notches 105 formed on the upper flange of the internal sleeve 102 of the body 10 of the knob 1 (FIG. 9E). Thereafter, the sensitivity ring 16 is unfastened by pressing the lock-cover 17 towards the interior of the body 10 of the knob 1 (FIG. 9F). The sensitivity ring 16 unfastened from the stator 14 thus compresses the spring 15. The upper end of the spring 15 thus bears against the annular surface defined by the internal collar 162 of the sensitivity ring 16. The barrel 11 as well as the other components, such as the control component 13, can thereafter be inserted to finalize the assembly of the product. The barrel 11 is mounted such that it grips the lock-cover 17 so as to engage the latter during the rotation of the key 2. The barrel 11 is positioned so that its tabs 110 face one of the lateral lugs 173 of the lock-cover 17.

FIGS. 8A to 8G represent according to a transverse section, a turning knob with lock with one or the other of the stators 14*a*, 14*b* taking various positions so as to offer various combinations of key withdrawals. The transverse section is a cut through the knob level with the top part of the stator.

With reference to FIGS. 8A to 8G, depending on the position of the stator 14 and the number of lateral openings 143*a*, 143*b* thereof, it is possible to obtain various combinations of key withdrawals. The position of the stator 14 with respect to the tabs 110 of the barrel 11 and therefore of the lock-cover 17 determines the position of the key withdrawals and, if the stator exhibits several lateral openings the possible number of key withdrawals.

Figure 8A:
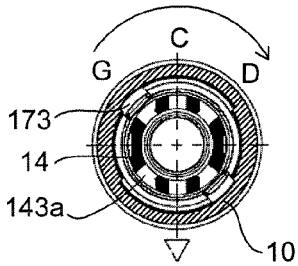
FIGS. 8A to 8G represent, seen from above and in transverse section, the various combinations of key withdrawals.
Figure 8B:
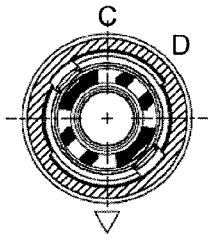
Figure 8C:
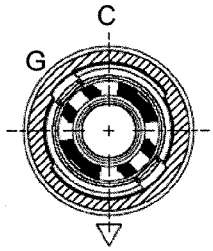
Figure 8D:
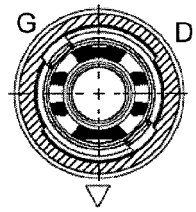

In FIGS. 8A to 8D, a stator 14*a* according to the first variant embodiment is used, furnished with six lateral openings 143*a*. The barrel 11 has a rotational sweep of a quarter turn symbolized by the arrow in FIG. 8A. In FIG. 8A, it is noted that over the rotational travel of the barrel 11, the tabs can position themselves opposite three lateral openings 143*a*. Withdrawal of the key 2 is therefore possible in the center (C), on the left (G) and on the right (D). In FIG. 8B, it is noted on the other hand that over the rotational travel of the barrel 11, the tabs 110 can only position themselves opposite two lateral openings. Withdrawal of the key 2 is therefore possible in the center (C) and on the right (D). In FIG. 8C, the withdrawal of the key 2 is possible in the center (C) and on the left (G) and in FIG. 8D, withdrawal of the key 2 is possible on the left (G) and on the right (D).

Figure 8E:
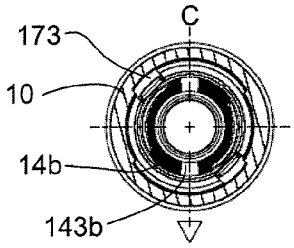
Figure 8F:
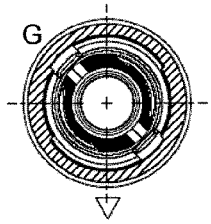
Figure 8G:
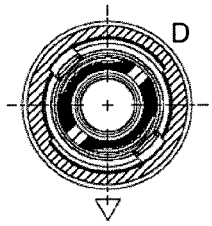

When a stator 14*b* similar to that of the second variant embodiment described above is used, a single key withdrawal 2 is permitted (FIGS. 8E to 8G). Depending on the position of this stator 14*b*, the withdrawal of the key 2 can be permitted in the center (C, FIG. 8E), on the left (G, FIG. 8F) or on the right (D, FIG. 8G).

Figure 12A:
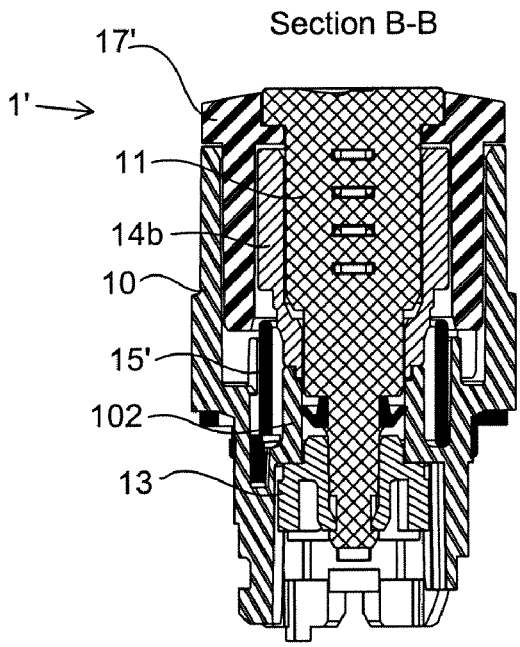
FIGS. 12A and 12B represent the sections on A-A and B-B of the knob with lock illustrated in FIG. 11.
Figure 12B:
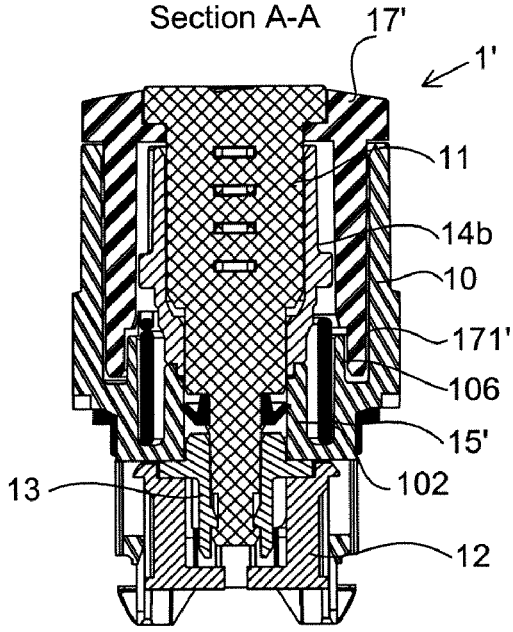

FIGS. 10 to 12B, illustrate a so-called restoring turning knob 1' with lock, that is to say one that can take two positions one of these positions being one providing a fleeting electrical contact for the electrical block. In this type of knob 1', a torsion spring 15' rather than a helical spring is therefore used. This torsion spring 15' is secured to the body 10 of the knob and the lock-cover 17', itself secured to the barrel 11. This spring 15' therefore loads the barrel 11 during the rotation of the latter. This so-called restoring type of knob, does not comprise any sensitivity ring 16 and therefore uses a different lock cover 17' from that used in a knob of the positions type. The end of the teeth 171' of this lock-cover 17' is not beveled and these teeth 171', during rotation, are disposed between the internal surface of the body 10 and the runners 106 formed thereon (FIG. 12B). The external surface of this lock-cover 17' is therefore situated opposite the internal surface of the body 10. The stator 14*b* used in this knob 1' simply exhibits two diametrically opposite lateral openings 143*b* and therefore permits only a single key withdrawal 2. The other parts of a restoring knob, in particular the positioning members used to position the stator in the body, are similar to those described above for a knob of the positions type.

It is of course understood that it is possible, without departing from the scope of the invention, to contemplate other variants and refinements of detail and likewise envisage the use of equivalent means.

The invention claimed is:

1. A turning knob with a lock for an electrical circuit, comprising:

a body;

a stator housed in said body and defining a plurality of openings, said stator having a plurality of positioning members;

a barrel defining an opening for a key and configured to turn inside said stator, the barrel including locking tabs configured to be received in said openings in said stator, said barrel including at one of its ends a shank actuatable by rotation of the key, wherein the body includes an internal cylindrical sleeve, the stator being positioned on said internal cylindrical sleeve, wherein the internal cylindrical sleeve includes a plurality of identical positioning members, each positioning member of the internal cylindrical sleeve being complementary to and collaborating with a corresponding positioning member of the stator so as to establish multiple positions of the stator with respect to the body, wherein each stator position, when held in engagement with the internal cylindrical sleeve, corresponds to a different rotational orientation of the openings in said stator with respect to the body, wherein the different rotational orientations of the openings in the stator, in cooperation with a rotational limit of the barrel within the stator, provide a variable number of key withdrawal positions.

2. The knob as claimed in claim 1, wherein the positioning members of the internal sleeve include identical notches formed on a flange of one of the ends of the internal sleeve cooperating with complementary flutes formed on an external surface of the stator.

3. The knob as claimed in claim 1, wherein the stator includes two diametrically opposite lateral openings, through which the tabs of the barrel are configured to project during withdrawal of the key.

4. The knob as claimed in claim 1, wherein the stator includes six diametrically opposite lateral openings through which the tabs of the barrel are configured to project during withdrawal of the key.

5. The knob as claimed in claim 1, wherein the body includes a flared part furnished with an external collar, a cup defined between the collar and the internal sleeve configured to receive a torsion spring loading the barrel during its rotation.

6. The knob as claimed in claim 1, wherein the stator has a top part and a bottom part, said bottom part having a diameter smaller than said top part.

7. The knob as claimed in claim 6, wherein said openings of said stator are provided in said top part, and wherein said positioning members are provided in said bottom part.

8. The knob as claimed in claim 1, wherein each key withdrawal configuration allows at least two key withdrawal positions and an equal number of positions of the barrel within the stator.

9. The knob as claimed in claim 1, wherein the stator, when held in engagement with the internal cylindrical sleeve, receives the locking tabs of the barrel in at least three rotational positions of the barrel within the stator; and wherein the at least three rotational positions of the barrel within the stator define a corresponding number of key withdrawal positions.

10. The knob as claimed in claim 7, wherein the stator is substantially cylindrical and includes, on the top part of the stator, two diametrically opposite flat surfaces and six diametrically opposite lateral openings.

11. A knob with a lock for an electrical circuit, comprising:

a body configured to house a barrel turning with respect to a stator, the barrel including tabs, receiving a key configured to take by rotation at least two functional positions and having at one of its ends a shank actuatable by rotation of the key, wherein the body includes an internal cylindrical sleeve on which the stator positions itself, wherein the internal sleeve includes a plurality of identical positioning members, each positioning member of the internal sleeve being complementary to a corresponding positioning member of the stator, so as to establish a position of the stator with respect to the body, wherein the body includes an external collar, wherein a cup defined between the collar and the internal sleeve is configured to receive a helical spring loading a sensitivity ring that can move in translation.

12. The knob as claimed in claim 11, further comprising a lock-cover housed in the body and secured to the barrel, the lock-cover exhibiting teeth configured to cooperate with cam shapes formed on a sensitivity ring.

13. The knob as claimed in claim 11, wherein the sensitivity ring is configured to be temporarily linked to the stator by an intermeshing mechanism.

14. The knob as claimed in claim 13, wherein the intermeshing mechanism includes at least two studs formed on a lateral wall of the stator, and wherein the ring is held bearing against a shoulder formed on the stator by the studs bearing on a collar formed on the ring.

15. A turning knob with a lock for an electrical circuit, comprising:

a body;

a stator housed in said body and defining a plurality of openings, said stator having a plurality of positioning members;

a barrel defining an opening for a key and configured to turn inside said stator, the barrel including locking tabs configured to be received in said openings in said stator, said barrel including at one of its ends a shank actuatable by rotation of the key, wherein the body includes an internal cylindrical sleeve, the stator being positioned on said internal cylindrical sleeve, wherein the internal cylindrical sleeve includes a plurality of identical positioning members, each positioning member of the internal cylindrical sleeve being complementary to and collaborating with a corresponding positioning member of the stator so as to establish multiple positions of the stator with respect to the body, wherein each stator position, when held in engagement with the internal cylindrical sleeve, corresponds to a different rotational orientation of the openings in said stator with respect to the body, wherein the different rotational orientations of the openings in the stator for each stator position, in cooperation with a rotational limit of the barrel within the stator, correspond to a different multiple key withdrawal configuration, and wherein each different multiple key withdrawal configuration utilizes a different set of the plurality of openings in the stator.

* * * * *